US005394575A

United States Patent [19]

Wolter et al.

[11] Patent Number: 5,394,575

[45] Date of Patent: Mar. 7, 1995

[54] BEACH MAT

[76] Inventors: Jon Wolter, 857-½ Bronson Rd., Fairfield, Conn. 06430; Kenneth Paolini, 786 Post Rd. E., Westport, Conn. 06880

[21] Appl. No.: 160,958

[22] Filed: Feb. 2, 1993

[51] Int. Cl.[6] ..... A47G 9/06

[52] U.S. Cl. ..... 5/419; 5/420; 5/633; 5/656

[58] Field of Search ..... 5/417, 419, 420, 633, 5/634, 656; 297/452.41

[56] References Cited

U.S. PATENT DOCUMENTS

| | | | |
|---|---|---|---|
| 2,857,957 | 10/1958 | Gay | 5/420 X |
| 3,606,623 | 9/1971 | Aymar | 5/634 X |
| 3,680,917 | 8/1972 | Harris | 297/452.41 |
| 4,101,994 | 7/1978 | Hoyt | 5/419 |
| 4,945,587 | 8/1990 | Ferro | 5/420 X |
| 5,022,107 | 6/1991 | Knotts | 5/419 |

FOREIGN PATENT DOCUMENTS

| | | | |
|---|---|---|---|
| 363675 | 6/1930 | United Kingdom | 5/417 |
| 962694 | 7/1964 | United Kingdom | 5/417 |

*Primary Examiner*—Michael F. Trettel
*Attorney, Agent, or Firm*—Patrick J. Walsh

[57] ABSTRACT

A portable bed or mat for use at the beach, pool, or elsewhere outdoors includes a pad of lightweight, soft material such as foam rubber covered with nylon for waterproofing, with an inflatble wedge head and shoulder rest at the head end of the mat extending a substantial distance along the length of the bed and provides support for both the head and shoulders adding to the comfort of the user. The mat is also provided with removable towelling attached to the top surface. Storage pockets form part of the mat at the foot end for receiving personal items such as car keys, reading material, sunglasses and so forth. The mat may be rolled into a compact tube shape, with ends secured by retaining clips, and with an integral shoulder strap for carrying the mat.

7 Claims, 1 Drawing Sheet

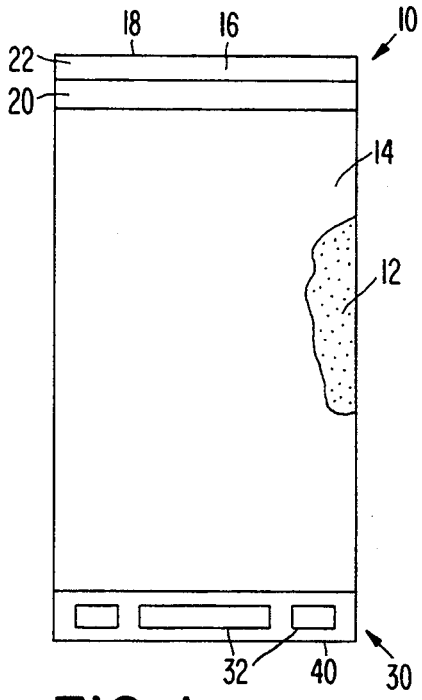
FIG. 1
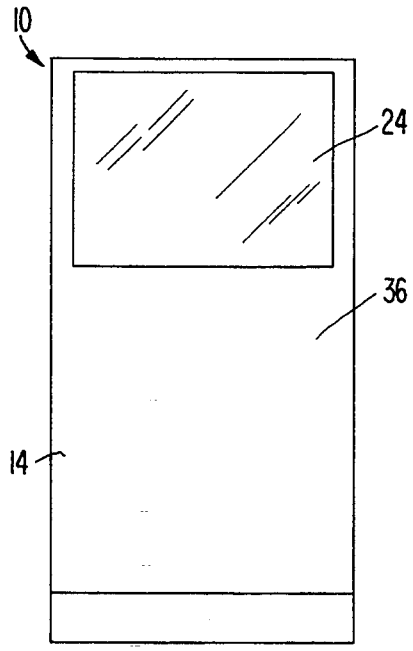
FIG. 2
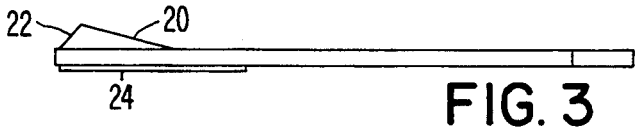
FIG. 3
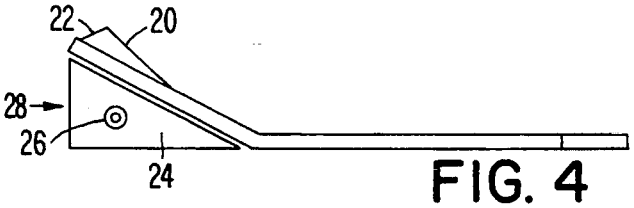
FIG. 4
FIG. 5
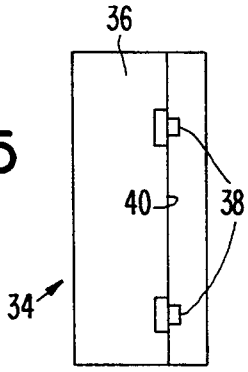
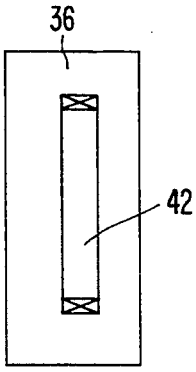
FIG. 6

BEACH MAT

BACKGROUND OF THE INVENTION

The present invention relates to a portable bed or mat for use at a beach, poolside or other outdoor location.

Beach blankets are commonly used for reclining at a seaside beach providing minimal protection from body contact with sand and a minimal comfort level.

The patent prior art reveals several attempts to provide a greater level of comfort for reclining at the beach.

U.S. Pat. No. 3,689,947 to Wolf discloses a towel combined with an inflatable pillow for use at a beach. The towel is formed at the head with a pocket for inserting and inflating the pillow.

U.S. Pat. No. 4,200,942 to Case is also directed to a beach towel having a flap at the head end for inserting an inflatable pillow.

U.S. Pat. No. 4,466,516 to Sicoli is is directed to a multipurpose sunblanket and tote bag used for sunning at the beach and equipped with a pillow and storage pockets. The device is laid out as a beach blanket and is folded up to form a tote bag.

U.S. Pat. No. 5,163,192 to Watson is directed to a sunbathing mat having a removably attachable headrest for use at a beach or pool.

There is need for an improved beach mat providing a greater level of utility, comfort, and practicality than available with beach mats and blankets with headrests as represented by the patent art.

SUMMARY OF THE INVENTION

The present invention comprises a portable bed or mat for use at the beach, pool, or elsewhere outdoors. In accordance with the invention, the mat includes a pad of lightweight, soft material such as foam rubber covered with nylon for waterproofing, with an inflatble wedge headrest at the head end of the mat for setup by the user when desired. The headrest extends a substantial distance along the length of the bed and provides support for both the head and shoulders adding to the comfort of the user. The mat is also provided with removable towelling attached by a fastener such as a zipper to the top surface. The towel may be removed and used for drying off or for laundering and thereafter reattached to the mat. If desired the towel may be decorated. Storage pockets form part of the mat and are preferably located at the foot end for receiving personal items such as car keys, reading material, sunglasses and so forth. After use, the mat may be rolled into a compact tube shape, with ends secured by retaining clips, and with an integral shoulder strap for carrying the mat.

OBJECTS OF THE INVENTION

It is an object of the invention to provide a portable beach bed.

It is an object of the invention to provide a mat with an inflatable head rest in the shape of a wedge with the head rest extending for a substantial portion of the length of the bed for supporting head and shoulders.

It is a further object of the invention to provide a beach mat of robust construction including a soft inner pad, a waterproof outer covering for the pad, an inflatable head and shoulders rest, storage pockets, and with the facility for being rolled into a tube for carriage by a shoulder strap.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which:

FIG. 1 is a top view of the mat.

FIG. 2 is a bottom view of the mat.

FIG. 3 is a side elevation of the mat.

FIG. 4 is a side elevation view of the mat with the head end elevated by an inflatable wedge.

FIG. 5 is a plan view of the mat rolled up for carriage showing securing clips.

FIG. 6 is a plan view of the mat rolled up for carriage showing a carrying strap.

DETAILED DESCRIPTION OF THE INVENTION

Referring to the drawing, the mat 10 has a generally rectangular configuration and comprises an inner pad 12 of soft material such as foam rubber and an outer covering 14 of waterproof material such as nylon. A padded headrest 16 extends across the head end 18 of the mat and is defined by a head panel 20 and a support panel 22. The headrest includes foam rubber padding in the form of a triangular block for giving shape to the headrest and is covered by the same material as the main body of the pad, i.e., nylon.

As shown in FIGS. 2 and 4, the mat is provided with an inflatable air bag 24 extending from the head end approximately one-third the length of the mat and from side to side. The air bag is constructed of an air tight plastic film material and may be secured to the bottom as shown in FIG. 2 or may be located within the mat between the underside of the pad and the inner surface of the waterproof covering. The air bag is provided with an air filling connection 26 for receiving pressurized air or for being blown up by the user. When inflated, the air bag forms a wedge 28 at the head end surmounted by the headrest for supporting the head and shoulders of the occupant of the mat. The result is a beach mat providing a substantial level of comfort while reposing at poolside or at the beach. The inflatable wedge acts as a chair when inflated.

The foot end 30 of the mat includes a set of pockets 32 for storing personal items such as keys and so forth. The pockets are preferable defined by the outer waterproof covering which is seamed at the bottom end of the inner pad and which extends a short distance beyond for accommodating several individual pockets. The pockets are thus formed between upper and lower layers of the waterproof covering and are provided with suitable fasteners such as zippers for closing each pocket.

A towel preferably of terry cloth is removably attached to the upper surface of the mat preferably by snap fastners with cooperating components attached to the towel and the mat.

For storage or carrying, the mat may be rolled up preferably from head to foot end into a compact tube 34 with the bottom of the mat 36 facing outward. Mating clips 38 are provided to secure the mat in rolled form. One set of clip components may be affixed to the the outer margin of the pocket extension while a matching set of clip components is attached to the mat bottom so that the clip components meet and engage each other when the mat is rolled for storage.

A backstrap 42 is also fitted to the mat bottom for ease of carrying the rolled mat.

We claim:

1. A portable mat comprising an elongate pad of soft material having a head end and a foot end, an inflatable air bag in the form of a wedge extending from the head end approximately one-third the length of the mat for supporting the head and shoulders of a figure reclining on the mat, a head rest surmounting the inflatable air bag, a waterproof cover for the pad, air bag, and head rest, and the air bag being located under the pad and over the waterproof cover.

2. A portable mat as defined in claim 1 which further comprises a pocket extension attached to the foot end of the mat.

3. A portable mat as defined in claim 1 which further comprises cooperating clip components attached to the foot end of the mat and to the underside of the mat for holding the form of the mat when it is rolled into a tube for storage.

4. A portable mat as defined in claim 3 which further comprises a carrying strap attached to the bottom of the mat.

5. A portable mat as defined in claim 1 in which the mat is fabricated of foam rubber and the cover of nylon.

6. A portable mat comprising an elongate pad of soft material having a head end and a foot end, an inflatable air bag constructed of air tight plastic film material in the form of a wedge secured to the bottom of the elongate pad and extending from the head end approximately one-third the length of the mat for supporting the head and shoulders of a figure reclining on the mat, a head rest surmounting the inflatable air bag, and a waterproof cover for the pad, air bag, and head rest so that when inflated the air bag forms said wedge and when deflated the entire mat structure may be rolled for storage or carrying.

7. A portable mat as defined in claim 6 which further includes fastening means for holding the mat in tubular form for storage and a carrying strap.

* * * * *

UNITED STATES PATENT AND TRADEMARK OFFICE

CERTIFICATE OF CORRECTION

PATENT NO. : 5,394,575

DATED : March 7, 1995

INVENTOR(S) : Wolter et al.

It is certified that error appears in the above-indentified patent and that said Letters Patent is hereby corrected as shown below:

On the title page:
Feb. 2, 1993 should read --Dec. 2, 1993 [22] On the title page.

Signed and Sealed this

Ninth Day of May, 1995

Bruce Lehman

*Attest:*

BRUCE LEHMAN

*Attesting Officer*

*Commissioner of Patents and Trademarks*